US007021002B2

(12) United States Patent
Nat

(10) Patent No.: US 7,021,002 B2
(45) Date of Patent: Apr. 4, 2006

(54) SLIDING REVOLVING DOOR

(75) Inventor: René Cornelis Nat, Purmerend (NL)

(73) Assignee: Boon Edam B.V., Edam (NL)

( * ) Notice: Subject to any disclaimer, the term of this patent is extended or adjusted under 35 U.S.C. 154(b) by 0 days.

(21) Appl. No.: 10/108,946

(22) Filed: Mar. 27, 2002

(65) Prior Publication Data

US 2002/0157315 A1 Oct. 31, 2002

Related U.S. Application Data

(63) Continuation of application No. PCT/NL01/00568, filed on Jul. 23, 2001.

(30) Foreign Application Priority Data

Aug. 1, 2000 (NL) ..... 1015852

(51) Int. Cl.
*E05D 15/02* (2006.01)

(52) U.S. Cl. ..... 49/43; 49/40; 49/41; 49/42; 49/138

(58) Field of Classification Search ..... 49/40, 49/41, 42, 43, 44, 45, 138; 109/2, 48, 59 T, 109/73

See application file for complete search history.

(56) References Cited

U.S. PATENT DOCUMENTS

| | | | | | |
|---|---|---|---|---|---|
| 455,656 | A | * | 7/1891 | Chew | 49/45 |
| 1,273,463 | A | * | 7/1918 | Dawes | 49/40 |
| 1,992,847 | A | | 2/1935 | Uhrich | |
| 2,029,914 | A | * | 2/1936 | Dreher | 49/43 |
| 4,341,165 | A | * | 7/1982 | Calandritti et al. | 109/8 |
| 4,843,761 | A | * | 7/1989 | Sandling | 49/41 |
| RE33,407 | E | * | 10/1990 | Schwarz | 49/42 |
| 5,542,211 | A | * | 8/1996 | Colombo | 49/42 |
| 5,987,817 | A | * | 11/1999 | Hein | 49/40 |

FOREIGN PATENT DOCUMENTS

| | | |
|---|---|---|
| DE | G94 20531.0 | 3/1995 |
| EP | 0 599 373 A1 | 6/1994 |
| EP | 0 799 962 A1 | 10/1997 |
| GB | 1 223 699 | 3/1971 |
| NL | 5614 | 5/1921 |

* cited by examiner

*Primary Examiner*—Gregory J. Strimbu
(74) *Attorney, Agent, or Firm*—Jeffrey D. Myers; Vidal A. Oaxaca; Peacock Myers, P.C.

(57) ABSTRACT

A revolving door comprising an at least partly cylindrical shell wall, which has an entrance and an exit, and two rotating door leaves, which during normal operation are in place extended in the opposite direction of each other inside the shell wall. Between the shell wall and an end of at least one door leaf, which end can move near and along the shell wall, a sliding door is provided, which is suitable for closing off the entrance or exit, respectively, and during normal operation the end of the door leaf is constantly positioned near the sliding door and between its lateral edges.

2 Claims, 2 Drawing Sheets

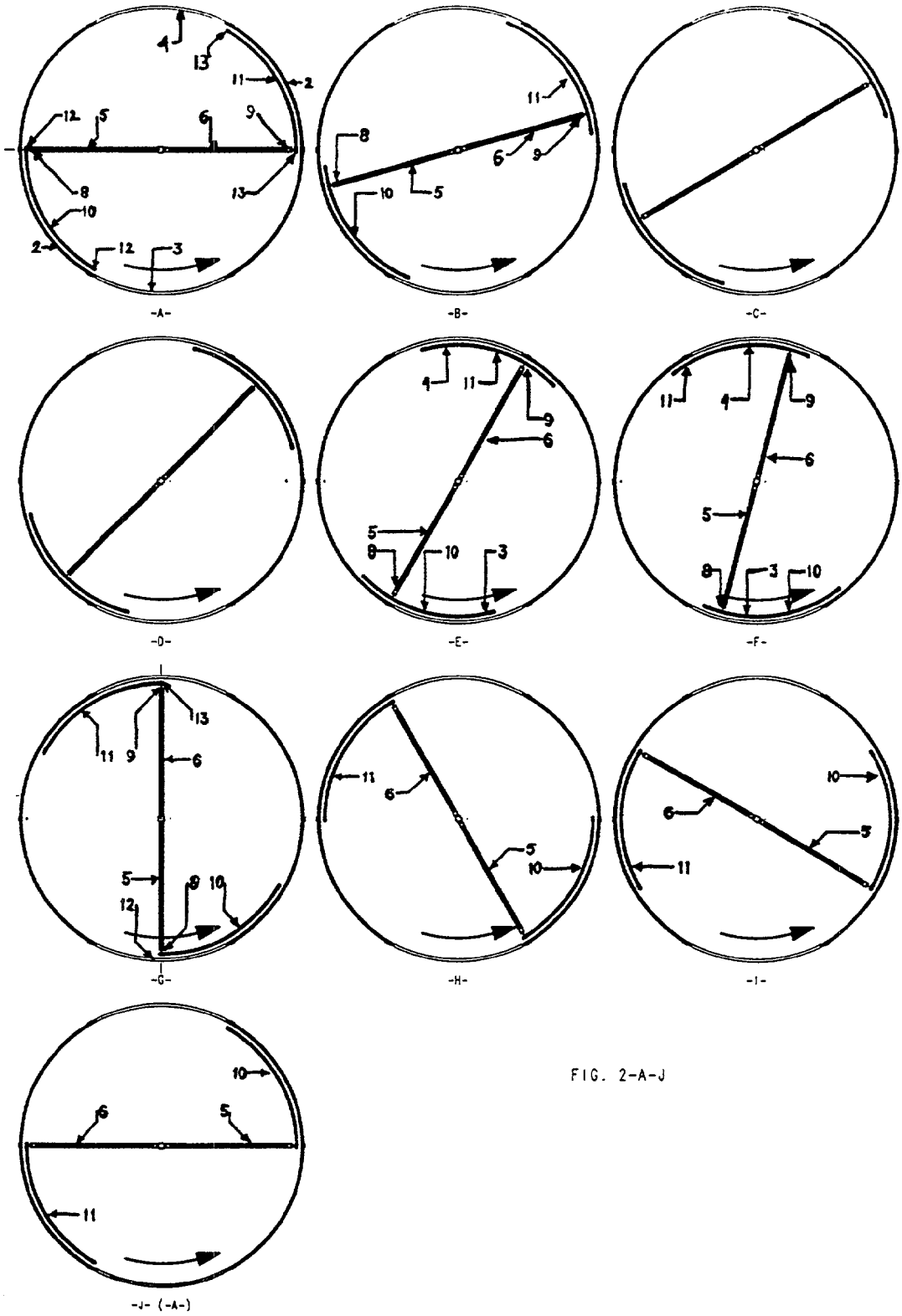
FIG. 2-A-J

SLIDING REVOLVING DOOR

CROSS-REFERENCE TO RELATED APPLICATIONS

This application is continuation application of International Patent Application Serial No. PCT/NL01/00568, entitled "Revolving Door" to Rene Cornelis Nat, having an international filing date of Jul. 23, 2001, and claiming priority to Netherlands Patent Application Serial No. 1015852, having a filing date of Aug. 1, 2000, and the specifications thereof are incorporated herein by reference.

BACKGROUND OF THE INVENTION

1. Field of the Invention

The invention comprises a revolving door comprising an at least partly cylindrical shell wall, including an entrance and an exit, and including two rotating door leaves which during normal operation are fully and oppositely extended inside the shell wall. Between the shell wall and an end of at least one door leaf, which end can move near and along the shell wall, a sliding door is provided, which is suitable for closing off either the entrance or exit, and during normal operation the end of the door leaf is constantly positioned near the sliding door and between its lateral edges.

2. Description of Related Art

Applicants have already been marketing such a revolving door for some considerable time. Since there is no barrier of any kind between the entrance and exit when the door leaves are in a particular position there is a problem of draught, unless further measures are taken. In order to avoid this draught problem, two such revolving doors are sometimes employed in practice, so that there is always one set of door leaves to form a barrier to an unhindered passage from the entrance of the first revolving door to the exit of the second revolving door. Such an embodiment involving a double revolving door is known from the European patent EP-B-0 663 981 in the name of applicants.

From DE-U-9420531 a revolving door is known embodied with an at least partly cylindrical shell wall, which is provided with an entrance and an exit and two rotating door leaves, which during normal operation are placed in each other's extended direction inside the shell wall, and whose ends open out into display cases. Between the shell wall and each display case at the end of the door leaf there is a sliding door. The rotation of the door leaves creates an open communication between the entrance and the exit of the prior art revolving door, giving rise to draught problems.

One object of the invention is the elimination of the draught problem of such an isolated, single revolving door.

To this end, the revolving door according to the invention is characterized in that the sliding door is independently suitable for closing off the entrance or exit, respectively, and in that during normal operation—at least during the passage of the door leaf—the end of the door leaf is constantly positioned near the sliding door and between its lateral edges. In this way the sliding door is able to provide a closure between the entrance and the exit, while the door leaves pass the entrance and exit to maintain the traffic of persons between entrance and exit of the revolving door.

In this way various revolving door embodiments are feasible. For example, the sliding door may be placed in a permanent rest position near the entrance or exit to allow the same to be closed off during the passage of a door leaf and to subsequently return to said rest position.

BRIEF SUMMARY OF THE INVENTION

A first preferred embodiment of the revolving door according to the invention is, however, characterized in that the end of the door leaves is constantly and permanently positioned near the sliding door and between its lateral edges, such that the door leaves and the sliding door synchronously move or stand still. This embodiment of the revolving door can be realized very simply and without many additional provisions, while completely fulfilling the objective of the invention.

A second preferred embodiment of the revolving door according to the invention is characterized in that in a start-up phase when the door leaves rotate, and the sliding door begins to close off the entrance or exit, respectively, the sliding door will move more slowly than the end of the door leaf that is located near the sliding door and between its lateral edges, and in that in a closing phase, which succeeds the start-up phase and in which the sliding door completely closes off the entrance or exit, respectively, said sliding door will move faster than the end of the door leaf, until the end of the door leaf and the lagging lateral edge of the sliding door are close together, and the door leaf and the sliding door synchronously move on or stand still, until the start-up phase starts anew. The advantage with this embodiment is that it has a larger capacity for passing through compared with the above-mentioned first preferred embodiment so that a larger number of people are able to use the revolving door within a certain time unit. Those interested in technology will find the intriguing concerted action between the door leaves and the sliding door especially inspiring.

Incidentally, it is desirable for all embodiments that two sliding doors be provided, coupled in pairs with the door leaves.

To all possible embodiments of the revolving door according to the invention applies that the same are preferably designed such that each of the door leaves is foldably coupled with a rotatable central column erected centrally inside the shell wall. This measure makes it possible in a simple way to create an emergency exit by folding back the door leaves. The consequence of their being attached to the rotatable central column is that when they are folded back, the door leaves will extend away from the sliding door or sliding doors, so that they can remove therefrom. A very convenient manner for realizing the fold-back embodiment of the door leaves is described in the Dutch patent 1003383 in the name of applicants.

BRIEF DESCRIPTION OF THE SEVERAL VIEWS OF THE DRAWINGS

The invention will now be further elucidated with reference to the drawings, which in FIG. 1, show a schematic top view of a first embodiment of the revolving door according to the invention;

in FIG. 2, in the sub-figures A to J, show in a schematic top view how the revolving door according to the invention functions in accordance with a second embodiment.

Identical parts in the figures carry the same reference numbers.

DETAILED DESCRIPTION OF THE INVENTION

Figure 1:
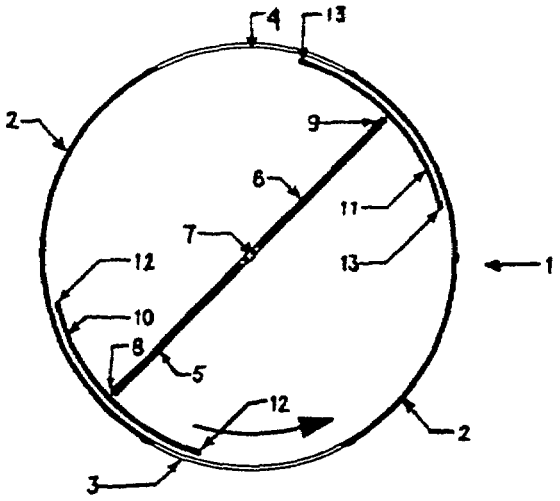

Referring now first to FIG. 1, where the revolving door according to the invention is indicated by reference number 1, and which is embodied with an at least partly cylindrical shell wall 2, which is provided with an entrance 3 and an exit 4. Such a revolving door 1 may be provided, for example, in the facade of a building or inside a building for the separation of different rooms that are in communication via the revolving door. Inside the shell wall 2, the revolving door 1 further comprises two rotating door leaves 5 and 6, which during normal operation are placed in each other's extended direction. Normal operation entails that the door leaves 5 and 6 in said position where the door leaves 5 and 6 lie in each other's extended direction, are able to stand still or to rotate about a central column 7. According to the invention, the revolving door 1 is now embodied such that a sliding door 10, 11 is provided between the shell wall 2 and an end 8 or 9, respectively, of at least one door leaf 5 or 6, respectively. This sliding door 10, 11 is dimensioned such that it is suitable to completely close off the entrance 3 or the exit 4, respectively. Preferably the end 8,9 of the door leaf 5,6 is constantly near the sliding door 10,11 and between its lateral edges 12,13. A first embodiment is thus shown in FIG. 1, wherein the end 8,9 of the door leaf 5,6, as shown in the figure, is located in a permanent position near the sliding door 10,11 and between its lateral edges 12,13 such that the door leaves 5,6 and the sliding door 10,11 synchronously move or stand still. Consequently, when the door leaves 5,6 are rotating, the situation will never arise where a free passage is formed between the entrance 3 and the exit 4 accompanied by draught, so that the draught problem is in this way effectively solved.

An alternative embodiment is shown in FIG. 2. Departing from the starting position shown in sub-figure A, and subsequently examining the sub-figures B, C, up to and including J, wherein the sub-figure J succeeding sub-figure I mutatis mutandis corresponds with sub-figure A, the following may be observed. During the rotation of the door leaves 5,6 in a start-up phase in which the sliding door 10,11 begins to close off the entrance 3 or the exit 4, respectively, as shown in the transition from sub-figure A to sub-figure B, the sliding door 5,6 moves more slowly than the end 8,9 of the door leaf 5,6 which is near the sliding door 10,11 and between its lateral edges 12,13. This situation is shown clearly in the subsequent sub-figures A, B, C and D of FIG. 2. The position shown in the sub-figure D, is approximately the position in which a closing phase begins that succeeds the start-up phase shown in the sub-figures A to D, and in which the sliding door 10,11 will completely close off the entrance 3 or exit 4, respectively. This is shown in the sub-figures E and F of FIG. 2. In this closing phase the sliding door 10,11 will move faster than the end 8,9 of the door leaf 5,6, until said end 8,9 of the door leaf 5,6 and the lagging lateral edge 12,13 of the sliding door 10,11 are close together, as shown in FIG. 2G. The FIGS. 2H to J then show that the door leaf 5,6 and the sliding door 10,11 subsequently synchronously move on from the position shown in FIG. 2G or stand still until the start-up phase shown in FIG. 2J starts anew. The position of the revolving door shown in FIG. 2J corresponds with that of FIG. 2A, with the exception that the door leaves 5 and 6, and the sliding door 10,11 have rotated 180°.

The embodiments discussed and illustrated so far always show two sliding doors 10,11. However, special attention is drawn to the fact that the advantages of the invention may also be achieved by using only one single sliding door 10 or 11. This is completely obvious to the person skilled in the art, so that no further elucidation is required.

Figure 3:
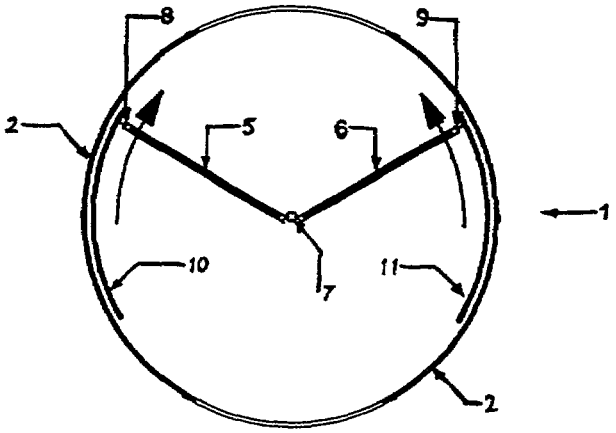
FIG. 3 shows the revolving door according to the invention when the door leaves are in the process of being moved.
Figure 4:
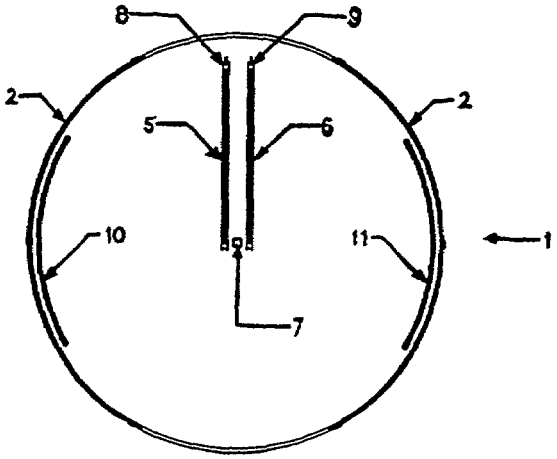
FIG. 4 shows the revolving door according to the invention when the door leaves have been moved into the emergency position.

FIGS. 3 and 4 finally show that each of the door leaves 5,6 is foldably coupled with a rotatable central column 7, erected centrally inside the shell wall 2. In FIG. 3, the begin phase of the door leaves 5,6 being folded is shown, wherein due to the door leaves 5 and 6 being attached to the central column 7 their being folded away causes the ends 8 and 9 of the door leaves 5 and 6 to move inward, so that they loose contact with the sliding doors 10 and 11. In the situation where the door leaves 5 and 6 are completely folded away as shown in FIG. 4, a suitable emergency exit is created providing a roomy passage for large numbers of people that may be on foot or in a wheelchair.

What is claimed:

1. A revolving door comprising:

an at least partly cylindrical shell wall, said cylindrical shell wall comprising an entrance and an exit; and two rotating door leaves which are placed inside said shell wall and that together span essentially a breadth of said partly cylindrical shell wall;

wherein between said shell wall and an end of at least one of said door leaves, said end moveable near and along said shell wall, a sliding door is provided that is suitable for closing off said entrance or exit;

wherein said sliding door can move in only one rotational direction; and wherein during rotation of said door leaves in a start-up phase, as said sliding door begins to close off said entrance or said exit, said sliding door moves more slowly than said end of said at least one door leaf which is between a first lateral edge and a second lateral edge of said sliding door, and wherein during a closing phase that succeeds said start-up phase, and in which said sliding door completely closes off said entrance or exit, said sliding door moves faster than said end of said at least one door leaf to complete said closing phase, until said end of said at least one door leaf and said second lateral edge of said sliding door are close together and said at least one door leaf and said sliding door synchronously move on, or stand still until, said start-up phase starts anew.

2. A revolving door according to claim 1, wherein each of said door leaves is foldably coupled with a rotatable central column erected centrally inside said cylindrical shell wall.

* * * * *